United States Patent [19]

Sweet

[11] Patent Number: 5,039,167

[45] Date of Patent: Aug. 13, 1991

[54] MOVABLE FOOTREST FOR HANDICAP AND STYLING CHAIR

[76] Inventor: Lloyd Sweet, 1806 Mepkin Rd., Apt. #A2, Charleston, S.C. 29407

[21] Appl. No.: 477,301

[22] Filed: Feb. 8, 1990

[51] Int. Cl.[5] ..... A47C 7/50

[52] U.S. Cl. ..... 297/433; 297/429

[58] Field of Search ..... 297/429, 433, 423

[56] References Cited

U.S. PATENT DOCUMENTS

| | | | |
|---|---|---|---|
| 611,327 | 9/1898 | Kelly | 297/429 |
| 682,325 | 9/1901 | Garrett | 297/429 X |
| 684,937 | 10/1901 | Johnson | 297/429 X |
| 1,279,120 | 9/1918 | Kellogg | 297/429 X |
| 3,453,027 | 7/1969 | Pivacek | 297/433 X |
| 3,679,257 | 7/1972 | Jacuzzi et al. | 297/433 X |
| 3,857,606 | 12/1974 | Rodaway | 297/429 |
| 4,486,048 | 12/1984 | Meyer | 297/433 |
| 4,765,684 | 8/1988 | Kualheim et al. | 297/429 |

*Primary Examiner*—Peter A. Aschenbrenner
*Attorney, Agent, or Firm*—Malin, Haley, McHale, DiMaggio & Crosby

[57] ABSTRACT

A footrest for a barber type chair that both pivots along a horizontal axis from a position under the chair to a position under the patron's feet and also rotates around a vertical axis from a position to the side of the chair to a position in front of the chair.

18 Claims, 3 Drawing Sheets

MOVABLE FOOTREST FOR HANDICAP AND STYLING CHAIR

BACKGROUND OF THE INVENTION

The subject matter of the invention relates to footrests for handicap and styling chairs and specifically to movable footrests for such chairs.

The nature of their profession requires barbers, beauticians, and other users of handicap and styling chairs to have their patrons seated while they perform hair cuts and the like. In order to provide comfort to these patrons, a variety of handicap and styling chairs have been developed that provide footrests. Many of these handicap and styling chairs provide footrests that can be raised or lowered either independently (e.g. U.S. Pat. No. 845,861, EDWARDS, U.S. Pat. No. 3,087,757, FIDEL) or in relation to and cooperation with the raising and reclining of the back, e.g. U.S. Pat. No. 352,242, HEINE, U.S. Pat. No. 263,174, HARTLEY.

A problem with footrests has been that the extended footrest gets in the way of patrons trying to become seated in the chair. Handicapped and elderly patrons often must be helped or lifted into the chairs presently existing in the art. Seating these people is complicated by the presence of the extended footrest, which must be stepped around while being seated. As can be seen, the danger of falling and subsequent injury is great with such apparatuses. Although this problem is most acute for the handicapped and elderly, it is also a problem for all people. Systems have been devised that hold the footrest out of the way of the patron while the patron seats himself and then moves the footrest into a comfortable position for the patron. This has been accomplished by rotating the footrest around a pivot along the front edge of the seat from a position under the seat to a position under the feet of the patron. FIDEL. This has also been accomplished by extending a footrest outward from under the chair seat essentially parallel to the ground from a position under the seat to a position under the feet of the patron. U.S. Pat. No. 649,383, WILCKE.

However, these types of systems to move footrests out of the way of patrons while seating themselves and then moving the footrest into a comfortable position for the patrons are relatively complex, usually involving gears and ratchets, or are cumbersome and awkward to use, as well as being difficult to adapt to today's smaller and lighter chairs because of their bulk and complexity.

It is therefore highly desirable to provide a simple and easy to use system of moving footrests out of the way of patrons while seating themselves and then moving the footrest into a comfortable, functional position for the patrons.

SUMMARY OF THE INVENTION

A footrest for a barber type chair that both pivots along a horizontal axis from a position under the chair to a position under the patron's feet and also rotates around a vertical axis from a position to the side of the chair to a position in front of the chair.

It is an object of the invention to provide a footrest that is positioned out of the patron's way while the patron seats himself.

It is a further object of the invention to provide a footrest that is easily placed under the patron's feet after the patron is seated.

It is another object of the invention to provide a simple footrest that can be moved into and out of a position under the patron's feet.

It is another object of the invention to provide an inexpensive footrest for a barber type chair.

It is yet another object of the invention to provide a movable footrest that is easy to use.

It is still another object of the invention to provide a device which can be retro-fitted to existing chairs.

It is still another object of the invention to combine the foregoing objects into a single footrest.

In accordance with these and other objects which will be apparent hereinafter, the invention will now be described with particular reference to the accompanying drawings.

DETAILED DESCRIPTION ON THE INVENTION

Figure 1:
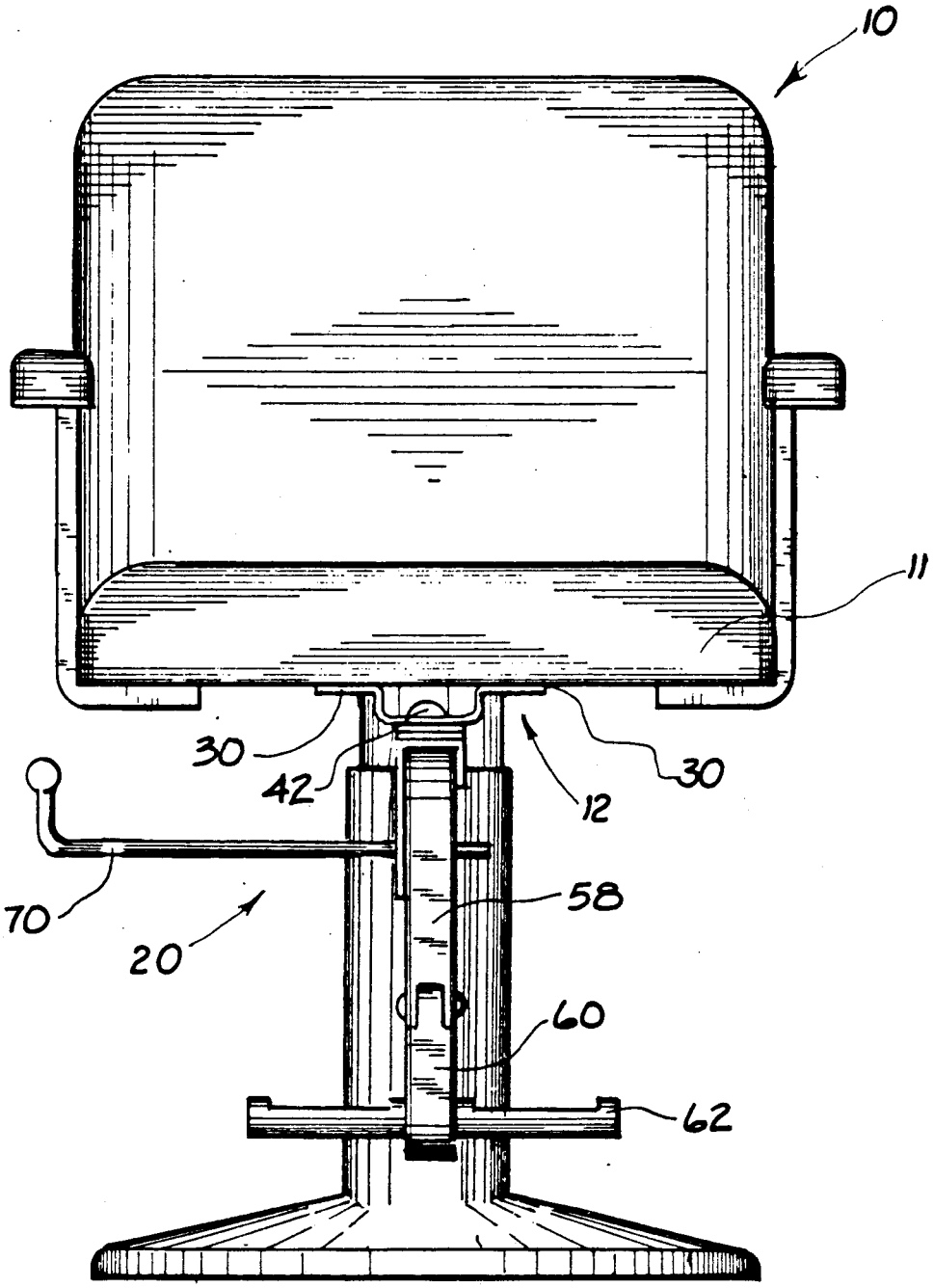
FIG. 1 is a front view of a handicap and styling chair showing the placement and connection of the invention in its functional position in front of the chair and extended so as to be under the patron's feet.

In FIG. 1 is shown the handicap and styling chair 10, having a seat 11. Centered to the seat 11 and attached to the underside of the seat 11 at 12 by a plate 30 is the invention, generally labeled 20.

Figure 4:
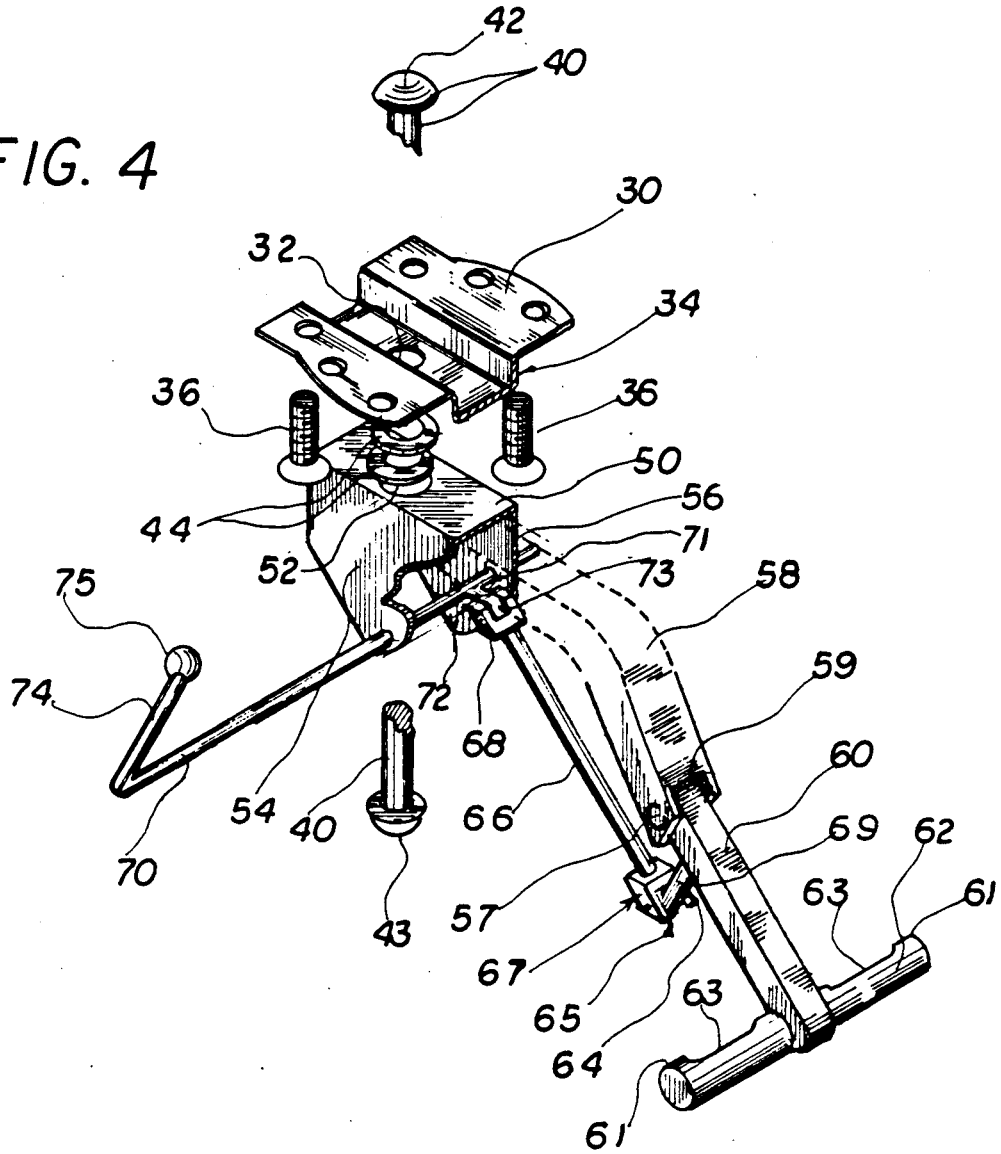
FIG. 4 is an exploded view of the invention showing the interconnection of the parts, the body of the invention being shown in cutaway to reveal the pivot arm, the connection arm, and their interconnection.

In FIG. 4 is shown an exploded view of the invention. A vertical pivoting rod 40 passes through a hole 32 in the plate 30. The rod 40 is expanded at both ends into caps 42, 43 presenting a flat surface toward the shaft of the rod 40. The plate 30 is bent so as to form a channel 34 of sufficient depth to allow the upper cap 42 to rest upon the bottom of the channel 34 without coming into contact with the bottom side of the seat 11 when the plate 30 is attached to the seat 11. The plate 30 is attached to the seat 11 at the attachment point 12 by bolts 36. The plate 30 is substantially oval shaped with holes 31 for receiving bolts 36 positioned around its outer edge. This configuration provides that no more than two holes 31 are in linear alignment, to reduce the possibility of fracturing of the underside of the seat 11 by stress from the invention 20 transfered to the underside of the seat 11 by the bolts 36.

After the rod 40 passes downward through the hole 32 in the plate 30, it passes through spacers 44 which position the body 50 a small distance away from the plate 30 to minimize physical contact, and thus friction, between the bottom of the plate 30 at the channel 34 and the top of the body 50.

Figure 2:
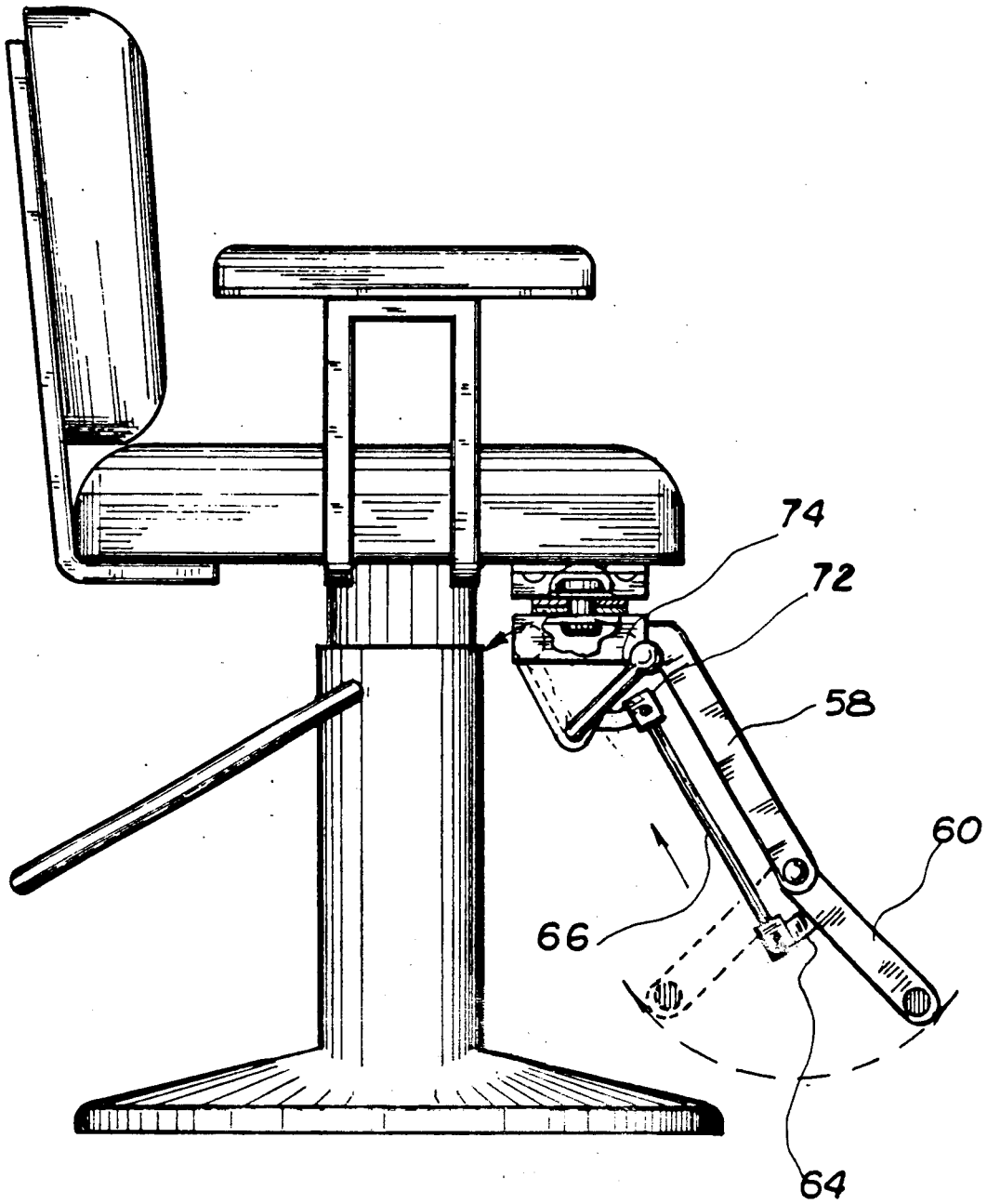
FIG. 2 is a side view of the handicap and styling chair show in FIG. 1 showing the invention in its functional position in front of the chair and extended so as to be under the patron's feet and showing by phantom drawing the position of the footrest and the extending mechanism when the footrest is retracted.

The body 50 is best seen in FIGS. 2 and 4 as a substantially channel-shaped, elongated piece having a hole 52, a pair of mirror image side plates 54, 56 and an elongated piece 58 (shown in cutaway in FIG. 4) ending in a body notch 59. The rod 40 extends downward through the spacers 44 and through the hole 52 in the body 50 where it ends in a lower cap 43. The length of the rod 40 is such that the body 50 is snuggly held through the spacers 44 to the channel 34 of the plate 30 by the interaction of the caps 42, 43 with the plate 30 and body 50 respectively.

An extension piece 60 pivots around a pin 57 extending horizontally through the body notch 59 of and has a foot bar 62 and a connecting mount 64 with a hole 65. Movably attached to the connecting mount 64 by a connecting arm notch 67 and a pin 69 at its first end is a connecting arm 66. Connecting arm 66 ends at its second end in a slot 68. Extending through the side walls 54 and 56 of the body 50 is a pivot bar 70. A pivot bar connecting rod 71 is connected at one end to the pivot bar 70 (at a 90 degree angle) inside the channel portion of the body 50 and ends at its other end in a pivot bar notch 72 interconnected with the connecting arm slot 68 of the connecting arm 66 by a pin 73. The end of the pivot bar 70 outside of the body 50 is bent at a 90 degree angle to provide a handle 74 ending in a ball 75. The pivot bar 70 is supported and positioned by its interaction with side walls 54 and 56.

In the preferred embodiment, the foot bar 62 has two flattened sides 63 to receive and position patrons feet. In addition, a flared piece 61 is provided at each of the outer edges of the flattened sides 63 to keep the patrons feet from falling off.

The operation of the invention is shown first in FIG. 2. In FIG. 2, the extension piece 60 is shown in its functional, extended position, connected to the connecting arm 66 at the connecting mount 64. Also shown is the handle 74 of the pivot arm 70, and the interconnection of the pivot bar notch 72 of the pivot bar connecting rod 71 with the connecting arm slot 68 of the connecting arm 66. As shown in phantom outline, when the handle 74 is rotated counter clockwise, the pivot bar 70, and consequently the pivot bar connecting rod 71 and the pivot bar notch 72 is rotated with it. Because the pivot bar notch 72 is interconnected with the enclosed loop 68, the connecting arm 66 is drawn along with the pivot bar notch 72. The movement of the connecting arm 66 is transferred to the connecting mount 64 and thus to the extension piece 60 causing it to rotate around the pin 57 through the body notch 59 of the extension piece 60 to a position under the seat 11. In this way, the foot bar 62 can be moved from a position under the patron's feet to a position under the seat 11 and out of the patron's way.

Figure 3:
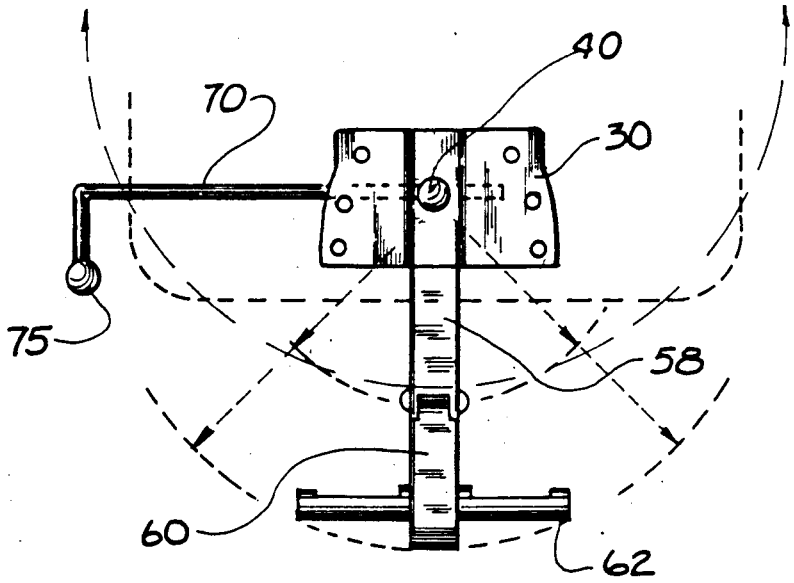
FIG. 3 is a top view of the connecting mechanism whereby the invention is attached to the chair showing the relative position of the invention to the chair body and the range of motion that the invention can rotated to as it rotates around its vertical pivoting axis.

In addition, as shown in FIG. 3, the invention rotates around the vertical pivoting rod 40 from a functional position in front of the chair to a position to the side of the chair 10. This allow the invention to be rotated out of the patron's way while the patron seats himself. The foot bar 62 and extension piece 60 are also moved into the retracted position under the seat 11 as described above so as to be out of the way of the barber as well as the patron. The device is then rotated around the vertical pivoting rod 40 into the functional position in the front of the chair 10. The foot bar 62 and extension piece 60 can then be moved into a position under the patron's feet by the reverse operation of the retracting process described above.

While there have been described above the principles of this invention in connection with a specific apparatus, it is to be clearly understood that this description is made only by way of example and not as a limitation to the scope of the invention. The instant invention has been shown and described herein in what is considered to be the most practical and preferred embodiment. It is recognized, however, that departures may be made therefrom within the scope of the invention and obvious modifications will occur to a person skilled in the art.

I claim:

1. A movable foot rest for handicap and styling chairs, said chairs having a seat, said foot rest being movable respective to said seat, said foot rest comprising:

(a) a body rotatable about a vertical axis, said vertical axis located below and extending through said seat;

(b) means, attached to said seat, for rotating said body about said vertical axis;

(c) means for supporting a patron's feet, rotatably attached to said body so as to rotate around a horizontal axis, said horizontal axis being tangential to an arc described by the point of attachment of said body to said means for supporting as said body is rotated about said vertical axis;

(d) means for rotating said means for supporting a patron's feet around said horizontal axis; and (e) means for connecting said body to said handicap and styling chairs.

2. A movable foot rest for handicap and styling chairs as described in claim 1 wherein said body is substantially elongated.

3. A movable foot rest for handicap and styling chairs as described in claim 2 wherein said body is substantially channelshaped.

4. A movable foot rest for handicap and styling chairs as described in claim 3 wherein said body further comprises:

(a) an elongated piece;

(b) an elongated first side plate attached at substantially a right angle to said elongated piece, wherein the elongated axes of said elongated piece and said first side plate are parallel; and (c) an elongated second side plate attached at substantially a right angle to said elongated piece opposite said first side plate so that a channel is formed between said first and second side pieces, wherein the elongated axes of said elongated piece and said second side plate are parallel.

5. A movable foot rest for handicap and styling chairs as described in claim 4 wherein said elongated piece ends in a notch and a pivot pin horizontally positioned through said notch.

6. A movable foot rest for handicap and styling chairs as described in claim 1 wherein said means for rotating said body about said vertical axis comprises:

(a) a plate mountably attachable to the underside of said seat of said styling type chair, said plate having a hole aligned with said vertical axis;

(b) a rod, expanded on each end, extending through said body and said plate through said hole in said plate whereby said expanded ends constrain said rod from passing through said body or said hole thereby holding said body in contact with said plate.

7. A movable foot rest for handicap and styling chairs as described in claim 6 wherein said plate has a channel shaped protrusion extending downward from said plate, said channel shaped protrusion containing said hole sized to receive said rod extending through said hole, said hole being smaller in diameter than said expanded end of said rod, whereby said expanded end of said rod does not contact the underside of said seat.

8. A movable foot rest for handicap and styling chairs as described in claim 1 wherein said means for supporting a patron's feet comprises:

(a) an extension piece pivotally attached to said body; and (b) a foot rest attached to said extension piece.

9. A movable foot rest for handicap and styling chairs, said chairs having a seat, said foot rest being movable respective to said seat, said foot rest comprising:

(a) a body, substantially elongated and channel shaped, having an elongated piece, an elongated first side plate attached at substantially a right angle to said elongated piece, wherein the elongated axises of said elongated piece and said first side plate are parallel; and, an elongated second side plate attached at substantially a right angle to said elongated piece opposite said first side plate so that a channel is formed between said first and second side pieces, wherein the elongated axises of said elongated piece and said second side plate are parallel, said body ending in a notch with a pivot pin horizontally positioned through said notch;

(b) a plate mountably attached to the underside of said seat of said barber type chair, said plate having a hole aligned with said vertical axis;

(c) a rod, expanded on each end, extending through said body and said plate through said hole in said plate whereby said expanded ends constrain said rod from passing through said body or said hole thereby holding said body in contact with said plate;

(d) an extension piece pivotally attached to said pivot pin through said notch of said body whereby said extension piece may rotate around a horizontal axis, said horizontal axis being tangential to an arc described by the point of attachment of said body to said means for support as said body is rotated about said vertical axis;

(e) a foot rest, attached to said extension piece;

(f) an elongated pivot bar, having a first and second end, rotatably attached at said first end to said body, said pivot bar extending through said first and said second side plates at substantially a right angle;

(g) a pivot bar connecting rod attached to said pivot bar, at said first end of said pivot bar at a right angle to said pivot bar, inside said body between said first and second side plates;

(h) a handle attached to said pivot bar at said second end of said pivot bar whereby said pivot bar may be rotated around its longitudinal axis; and, (i) a connecting arm having a first and second end, said first end of said connecting arm attached to said extension piece, and said second end of said connecting arm rotatably connected to said pivot bar connecting rod.

10. A movable foot rest for handicap and styling chairs, said chairs having a seat, said foot rest being movable respective to said seat, said foot rest comprising:

(a) a body rotatable about a vertical axis, said vertical axis located below and extending through said seat;

(b) means, attached to said seat, for rotating said body about said vertical axis;

(c) means for supporting a patron's feet, rotatably attached to said body so as to rotate around a horizontal axis, said horizontal axis being tangential to an arc described by the point of attachment of said body to said means for supporting as said body is rotated about said vertical axis;

(d) means for rotating said means for supporting a patron's feet around said horizontal axis comprising:

an elongated pivot bar, having a first and second end, rotatably attached to said body at said first end of said pivot bar;

a pivot bar connecting rod attached to said pivot bar at said first end of said pivot bar at a right angle to said pivot bar;

a handle attached to said pivot bar at said second end of said pivot bar whereby said pivot bar may be rotated around its elongated axis;

a connecting arm, having a first and second end, said first end of said connecting arm attached to said means for supporting a patron's feet, and said second end of said connecting arm pivotally attached to said pivot bar connecting rod;

whereby rotation of said pivot bar by said handle around the elongated axis of said pivot bar rotates said pivot bar connecting rod in an arc around said elongated axis thereby moving said connecting arm which in turn moves said means for supporting a patron's feet around said means for rotating said means for supporting a patron's feet; and, (e) means for connecting said body to said handicap and styling chairs.

11. A movable foot rest for handicap and styling chairs as described in claim 10 wherein said pivot bar connecting rod and said second end of said connecting arm are connected by a notch and slot connection with a pin extending therethrough whereby said pivot bar connection and said second end of said connecting arm, though constrained to move together by their connection through said notch and slot connection, are able to pivot about said pin.

12. A movable foot rest for handicap and styling chairs as described in claim 10 wherein said body is substantially elongated.

13. A movable foot rest for handicap and styling chairs as described in claim 12 wherein said body is substantially channel-shaped.

14. A movable foot rest for handicap and styling chairs as described in claim 13 wherein said body further comprises:

(a) an elongated piece;

(b) an elongated first side plate attached at substantially a right angle to said elongated piece, wherein the elongated axes of said elongated piece and said first side plate are parallel; and (c) an elongated second side plate attached at substantially a right angle to said elongated piece opposite said first side plate so that a channel is formed between said first and second side pieces, wherein the elongated axes of said elongated piece and said second side plate are parallel.

15. A movable foot rest for handicap and styling chairs as described in claim 14 wherein said elongated piece ends in a notch and a pivot pin horizontally positioned through said notch.

16. A movable foot rest for handicap and styling chairs as described in claim 10 wherein said means for rotating said body about said vertical axis comprises:

(a) a plate mountably attachable to the underside of said seat of said barber type chair, said plate having a hole aligned with said vertical axis;

(b) a rod, expanded on each end, extending through said body and said plate through said hole in said plate whereby said expanded ends constrain said rod from passing through said body or said hole thereby holding said body in contact with said plate.

17. A movable foot rest for handicap and styling chairs as described in claim 16 wherein said plate has a channel shaped protrusion extending downward from said plate, said channel shaped protrusion containing said hole sized to receive said rod extending through said hole, said hole being smaller in diameter than said expanded end of said rod, whereby said expanded end of said rod does not contact the underside of said seat.

18. A movable foot rest for handicap and styling chairs as described in claim 10 wherein said means for supporting a patron's feet comprises:

(a) an extension piece pivotally attached to said body; and (b) a foot rest, attached to said extension piece.

* * * * *